United States Patent [19]

Ehrlich et al.

[11] Patent Number: 4,517,955

[45] Date of Patent: May 21, 1985

[54] STOVE SAFETY GUARD

[76] Inventors: Conrad P. Ehrlich; Sandra L. Ehrlich, both of 1243 Beacon St.; 3B, Brookline, Mass. 02146

[21] Appl. No.: 550,823

[22] Filed: Nov. 14, 1983

[51] Int. Cl.[3] ..... F24C 15/10

[52] U.S. Cl. ..... 126/211; 126/214 R; 126/42

[58] Field of Search ..... 126/214 R, 214 A, 214 D, 126/216, 98, 42, 24, 201, 202, 22, 277, 278, 279

[56] References Cited

U.S. PATENT DOCUMENTS

| | | | |
|---|---|---|---|
| 163,858 | 6/1875 | Enos | 126/332 |
| 1,903,262 | 3/1933 | Goings | 126/214 |
| 2,699,162 | 1/1955 | Nazzaro | 126/24 |
| 2,771,873 | 11/1956 | Baker | 126/124 |
| 2,772,414 | 11/1956 | Baker | 126/24 |
| 2,778,356 | 1/1957 | Pugach | 126/42 |
| 3,043,289 | 7/1962 | Fox | 126/42 |
| 3,513,826 | 5/1970 | Hellmuth | 126/42 |
| 4,155,343 | 5/1979 | Hartmann | 126/211 |
| 4,157,705 | 6/1979 | Caan | 126/24 |

FOREIGN PATENT DOCUMENTS

| | | | |
|---|---|---|---|
| 859060 | 7/1949 | Fed. Rep. of Germany | 126/21 |
| 70933 | 12/1944 | Norway | 126/21 |
| 168696 | 7/1955 | Sweden | 126/214 R |
| 199633 | 6/1923 | United Kingdom | 126/214 R |
| 798376 | 1/1955 | United Kingdom | 126/214 R |
| 888704 | 11/1959 | United Kingdom | 126/214 R |
| 924944 | 5/1963 | United Kingdom | 126/214 R |
| 942382 | 11/1963 | United Kingdom | 126/214 R |

*Primary Examiner*—James C. Yeung

*Attorney, Agent, or Firm*—David G. Conlin; Robert T. Gammons

[57] ABSTRACT

A barrier system for the top of a range along one or more sides thereof comprising for each side a barrier member, a support for detachably attaching the barrier member to interengageable hinge elements on the support and barrier member supporting the barrier member for rotation about an axis parallel to the side of the range to which the barrier member is attached, and interengageable latch members interengageable by rotation of the barrier member to a perpendicular position to lock the barrier member in said perpendicular position and manually disengageable to release the barrier member to permit it to be rotated to a substantially horizontal position.

19 Claims, 18 Drawing Figures

STOVE SAFETY GUARD

BACKGROUND OF THE INVENTION

The present invention relates to a safety device apparatus for use on a stove or range, more particularly to a safety guard that inhibits intentional or accidental access to heating units or containers of hot substances thereon, and particularly to a stove guard that inhibits a child from contacting hot elements on the stove top or from grasping any pot or pan on the stove top.

SETTING FOR THE INVENTION

Foods are most often heated for cooking purposes on a range or stove in the kitchen area of the home. Since the kitchen is most often a center of activity in the home, it is both enticing and dangerous to children. The countertop and stove are normally positioned at a height convenient to the adult user. However, young children often attempt to reach the countertop surface or articles placed thereon. Even young children can reach above their height and touch the heated units of a stove or range, or pull a cooking vessel off the stove onto themselves, with disastrous consequences. Therefore, the stove creates a substantial danger to unattended children, and is often the cause of severe injuries. Similar dangers are presented to many handicapped persons, who can suffer burns by inadvertently contacting burners or cooking containers.

This problem has been well known for some time and apparatus of various designs has been devised to prevent such injuries. For example, see U.S. Pat. Nos. 163,858; 1,903,262; 2,699,162; 2,772,414; 2,771,873; 2,778,356; 3,513,826; 4,155,343; 4,157,705; British Pat. Nos. 199,633; 798,376; 888,704; 924,944; 942,382; Norwegian Pat. No. 70933; Swedish Pat. No. 168,696 and West German Pat. No. 859,060, the disclosures of which are incorporated herein by reference.

One disadvantage of the previous methods is the difficulty in removal of the barrier once the necessity for restricting access to the stove top has passed. Many devices are permanently attached by fasteners to the body of the stove. Their removal and replacement is consequently too time consuming to be performed on an "at-will" basis. Thus, the guard device may become a barrier and a nuisance when its preventive or protective function is not required. Such a device is unsatisfactory or impractical from the point of view of the consumer and therefore unattractive to the manufacturer. Those devices that detach from the stove still require removal and replacement, and they also require space in the cooking area for storage.

Subsequent modifications of previous guards include several attached devices that provide a hinging mechanism so that the guard may be lifted from the front of the stove and rotated toward the rear. Thus, the majority of the guard is no longer inhibiting access to the stove top. However, the danger of the guard accidentally falling forward could present a serious hazard by striking an adult or child, or by striking a cooking utensil containing heated foodstuffs. Other designs of stove guards have provided access to the stove top by removal of the front portion of the guard, either by hinging on the corners and swinging open like a gate or hinging at the stove surface and swinging down across the front of the stove. These designs still present additional obstacles to convenient operation of the stove. Although the majority of these devices are a retrofit design, many of them do not satisfy the consumer needs of ease of removal, replacement or safety. Thus, many of these devices are unsatisfactory or impractical from the point of view of the consumer and, therefore, unattractive to the manufacturer.

Therefore, new designs for stove guards are desired for solutions to these problems and to overcome the disadvantages of the previous designs for use on a stove or range.

It is among the objects of this invention to provide barriers for application to one or more sides at the top of a range which will be at least as effective as those previously known, and, in addition, will have the advantage that they can be applied without alteration of the range, can be moved to an out-of-the-way position without inconvenience and without hazard, and which are inexpensive to manufacture and can be easily removed without the aid of tools. The present invention presents a novel solution of the aforesaid problems by providing a stove guard that inhibits children from touching heating units or from grasping containers that may provoke injury. The stove guard of the present invention provides a device with the distinct advantages of ample protection to young children and others and yet it is readily movable to provide access to the cooking surface. Thus, the device provides a practical solution to the desires of the consumer or user for safety and convenience.

SUMMARY OF THE INVENTION

The present invention provides a stove barrier that inhibits access to the stove burners or cooking containers thereon. The stove barrier comprises an anchor portion having fastening means to inhibit the movement of the anchor portion, a holding mechanism and a means for supporting the barrier. The anchor portion is securely attached to the stove's horizontal or vertical surface and provides an anchor for the stove barrier. The fastening means are used to attach the holding mechanism or support bar to the anchor portion and may aid in adjustment of the anchor portion. The holding mechanism removably attaches to the barrier and provides substantially vertical and/or horizontal positioning.

In one embodiment the stove guard of the present invention herein comprises a retrofit perimeter barrier removably attached to a holder mechanism affixed to the stove wherein the barrier rotates in the holder and is held in a vertical position by a latch mechanism. The term "stove" may be defined as a portable or fixed apparatus that burns fuel or uses electricity to provide heat through grills or burners inset in the top surface of the unit, such as those used for heating or cooking. The term "stove" therefore, includes, but is not limited to, a stove, range, hotplate, cooker, cooking unit, etc. The anchor mechanism may utilize magnetic means, mechanical fastening means such as screws or bolts, or an adjustable gripping device removably attached to the stove top by grasping the edges of heating element holes. Thus, the holder mechanism provides a stationary support into which the barrier can be inserted and fastened.

In accord with the present invention, a stove guard anchor mechanism is attached to the stove top and the holder mechanisms are positioned approximately at the perimeter (three exposed edges) of the stove top, e.g., along those edges from which the stove top is readily accessible. The holder mechanisms are positioned to provide support for the barrier panels on one, two or three of the exposed sides of the cook top. When a barrier is required, one or more barrier panels may be inserted into the holders and latched into their protective positions. To remove or reposition the barriers for convenience, the latch mechanism is disengaged from the barrier, the barrier panel is rotated slightly and/or removed. The shape of the holder mechanisms and any complementary spaces provided in the barrier panels direct the movement and position of the barrier.

As herein illustrated, the barrier system in one form comprises along one or more sides of a range, a barrier member corresponding in length to but narrower in width than the length of the side of the range to which it is mounted, support means for the barrier member, means for detachably attaching the support means to the range, hinge means supported by the support means adjacent the top and parallel to the side of the range to which the barrier is to be mounted, complementary hinge means at one longitudinal edge of the barrier member for rotatably receiving the hinge means, supported by the support means for rotation of the barrier member about an axis parallel to the side of the range from a position substantially perpendicular to the top to a substantially horizontal position, interengageable latch means associated with the respective hinge means interengageable by rotation of the barrier member to said substantially perpendicular position to lock the barrier member in said substantially perpendicular position, said latch means being manually disengageable to release the barrier member to permit it to be rotated to said substantially horizontal position, and means at said horizontal position of the barrier member to support it in said substantially horizontal position. The support means can be detachably attached to the top or side of the range.

In the preferred form, the complementary hinge means are telescopically interengageable to enable removing the barrier member from the support means and the support means are, in turn, detachably attached to the range so that, when desired, both the barrier and the support means therefor can be removed from the range. The means for detachably attaching the support means to the top or side of the range in one form comprises one or more permanent magnets. Desirably, there are two support means, each provided with hinge mean and the barrier member is provided with two hinge means for engagement with the two hinge means provided by the two support means. Alternatively, the support means for detachably attaching the support means to the range comprise clamping means structured to be detachably engaged with adjacent burner openings at the top of the range and means for attaching the support means to the clamp means. The means for attaching the support means to the clamp means may be a bolt and wing nut. The hinge means supported by the support means is a channel member of circular cross section having an opening longitudinally thereof and the hinge means at the longitudinal side of the barrier member is a cylindrical member of a cross section to be rotatably received in the channel member. The distance between the edges defined by the opposite sides of the opening in the channel member is narrower than the diameter of the cylindrical member, but greater than the thickness of the barrier member so as to permit rotation of the barrier member from its vertical position to its horizontal position. In one form, the latch means comprises a recess longitudinally of the surface of the cylindrical member and means defining a lip longitudinally of the channel member yieldably enageable within the recess. Alternatively, the latch means comprises an opening in the longitudinal edge of the barrier plate defining an edge and a yieldable catch on the channel member engageable with the edge by rotation of the barrier member to said perpendicular position.

The invention will now be described in greater detail with reference to the accompanying drawings, wherein.

Figure 1:
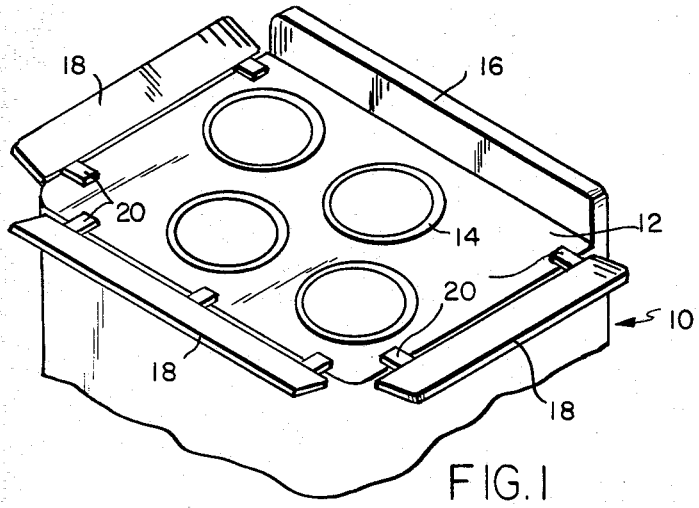
FIG. 1 is a fragmentary perspective view at the top of a typical range, whether electric or gas, showing the barrier means of this invention applied to three sides, the front and two opposite sides.

Referring to the drawings, FIG. 1, there is shown the upper part of a range 10 provided with a top panel 12 containing burner openings 14 of which four are shown, a back panel 16 herein shown as permanently attached and three barriers 18 attached, respectively, to the front side and the two opposite sides at right angles thereto. As shown, the barriers 18 are flat plates comprised of suitable material, are of rectangular configuration corresponding substantially in length to the side of the range to which they are to be attached and are relatively narrow in width from bottom to top. Each barrier plate 18, as shown in FIG. 1, is detachably attached to the top panel 12 of the range by two support means 20—20, one at each end; however, it is to be understood that a single support means 20 midway between the opposite ends of the barrier plate may be employed for this purpose or more than two support means may be employed, for example, support means midway between the opposite ends of the barrier plate and support means at each end of the barrier plate.

Figure 2:
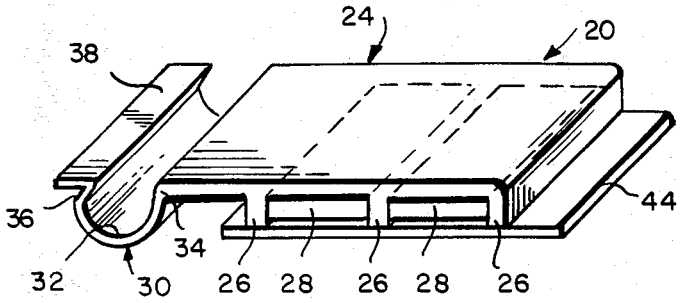
FIG. 2 is a perspective to much larger scale of the support means for a barrier detachably attached to the top of the range.

The support means 20, as shown in FIG. 2, comprises an anchor plate 24 which, in its preferred form, has at its underside spaced, transversely-extending spacer flanges 26 which, when the support means is placed on the top panel 12 of the range, supports it in spaced, parallel relation to the top plate. This provides for clearance of a bead at the edge of the top panel of the range, if there is one. Between the flanges 26, there are positioned permanent magnets 28 which, by contact with the top plate 12 of the range, anchor the support means 20 to the top plate. At one end of each anchor plate 24, there is hinge means 30 defining a cylindrical channel 32, the axis of which is parallel to the end of the anchor plate 24 to which it is attached. The channel member is integral at one longitudinal edge 34 with the anchor plate 24 and has at its other longitudinal edge an engaging lip 36, which is parallel to the edge 34. The distance between the edge 34 and the lip 36 is less than the diameter of the channel which, as shown, is of generally circular cross section. A flange 38 preferably extends horizontally from the lip 36 substantially in the plane of the anchor plate 24. The channel member 32 is desirably of such gage as to be somewhat elastic.

Figure 3:
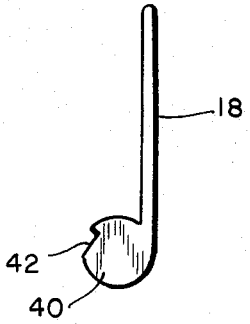
FIG. 3 is an end elevation of a barrier.
Figure 4:
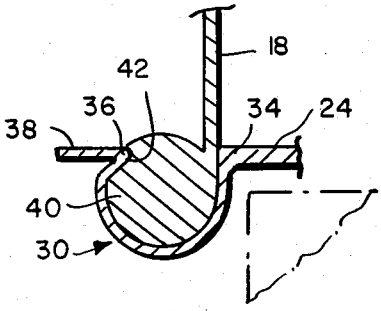
FIG. 4 is a fragmentary section showing a barrier supported by the support means in a position substantially perpendicular to the top of the range, the latter being shown in dot and dash lines.
Figure 5:
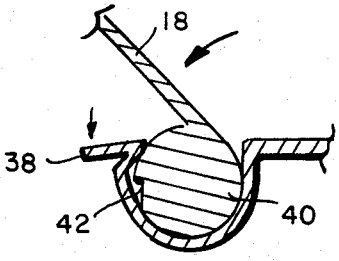
FIG. 5 is a view similar to FIG. 4 showing the barrier partially retracted from its perpendicular position.

The barrier plate 18, FIG. 3, as previously stated, is a flat plate and has at one edge one or more cylindrical portions 40, depending upon how many support means are to be employed, of generally circular cross section, dimensioned to be received within the channel member 32 for rotation about a horizontal axis parallel to the side of the range to which it is to be mounted. The cylindrical portion 40 contains a notch 42 longitudinally thereof for receiving the lip 36 so that when the barrier plate is mounted in the support means and moved to its vertical position, the lip 36, by engagement with the notch 42, will hold the barrier plate in position. The barrier plate may be manually released and rotated to a position substantially parallel to the top of the range, as shown in FIG. 5, into engagement with the supporting flange 38.

Figure 6A:
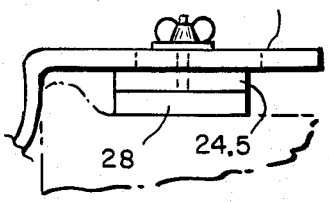
FIG. 6A is an elevation like FIG. 6 showing the use of a spacer between the anchor plate and magnet.
Figure 6:
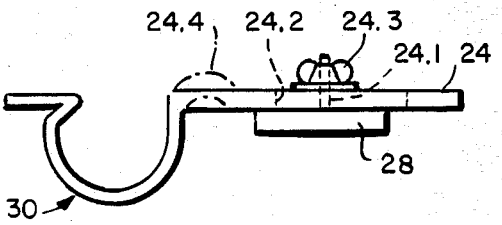
FIG. 6 is an elevation of an alternative form of support means with magnet adjustably attached thereto.

In this form of the invention, two permanent magnets 28—28 are shown for the purpose of detachably attaching the anchor plate 24 to the top of the range. The magnets 28—28 are recessed between the flanges 26. The support means may optionally comprise a flat anchor plate 24 as shown in FIG. 6 to which one or more magnets 28 are detachably attached by means of bolts 24.1 attached at one end to the magnet or magnets which extend through slots 24.2 in the anchor plate and are detachably secured therein, e.g. by wing nuts 24.3. When a flat anchor plate 24 is used as disclosed in FIG. 6, the end to which the hinge means 30 is attached may be arched as shown in dot and dash lines at 24.4 to clear the shoulder at the top of the range. Optionally, a spacer 245 may be used between the magnet 28 and the anchor plate 24 as shown in FIG. 6A to provide for adjusting the plate heightwise of the range.

In order not to damage the top panel 12 of the range, particularly if it has an enamel finish, a protective pad 44 (FIG. 2) of rubber or other soft material may be placed between each anchor plate and the top of the range. The protective pad 44 also functions to prevent horizontal slippage.

Figure 7:
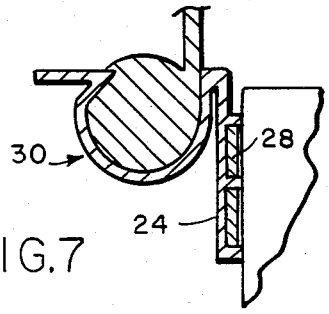
FIG. 7 is a fragmentary section of the support means structured to be attached to the side of the range.

FIG. 7 shows the support means 20 modified to enable detachably attaching it to the side of the range, wherein the anchor plate 24 is parallel to the hinge means 30 and has one or more magnets 28 recessed into its surface.

Figure 8:
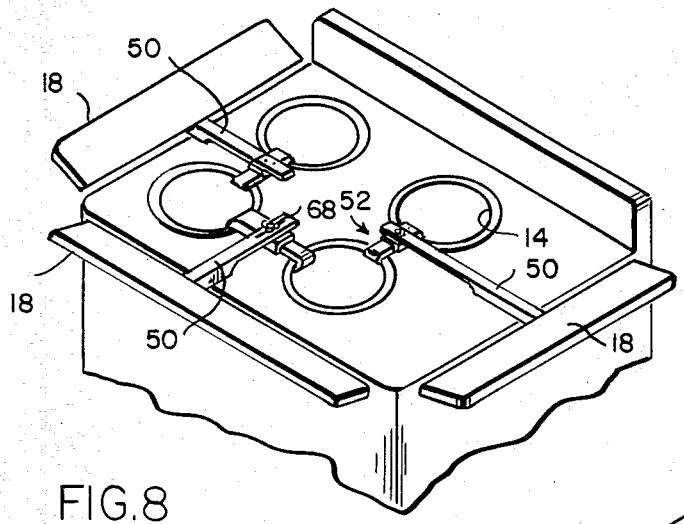
FIG. 8 is a fragmentary perspective of the top of a range which may be electric or gas provided with an alternative form of holder showing barrier means at the front and two sides and showing an alternative form of support means.
Figure 9:
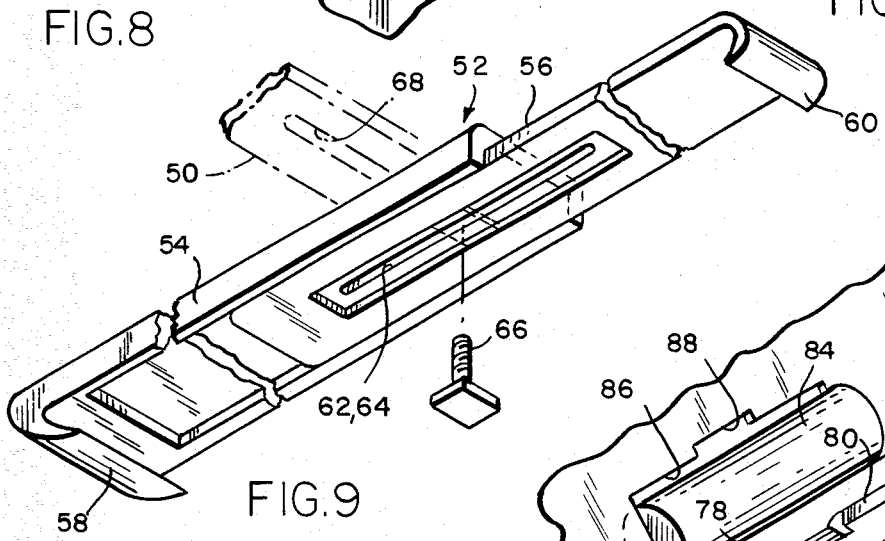
FIG. 9 is a perspective of the alternative form of means for adjustably attaching the support means to the range.

FIGS. 8 and 9 show an alternative form of support means for the barrier plates 18 comprising an anchor bar 50, to one end of which the barrier is hinged, and clamping means 52, FIG. 9, for attaching the other end of the support means to a pair of adjacent burner openings 14—14 at the top of the range, FIG. 8. The clamping means 52, as shown in FIG. 9, comprise telescoping parts 54 and 56 having at their opposite ends hooks 58 and 60 and intermediate their ends slots 62 and 64 for receiving a bolt 66 which is inserted through the slots from the lower side and secured at the upper side by a wing nut 68. The parts 54 and 56 are adjusted longitudinally relative to each other to engage the hooks 58 and 60 with the burner openings 14, whereupon the anchor bar 50, which is provided with a slot 69, is placed over the upper end of the bolt 66 projecting upwardly through the slots 62 and 64 and the wing nut 68 is applied so as to simultaneously clamp the parts in fixed relation to each other and to clamp the anchor bar 50 in a position extending at right angles to the side of the range to which the barrier plate is to be attached.

Figure 11:
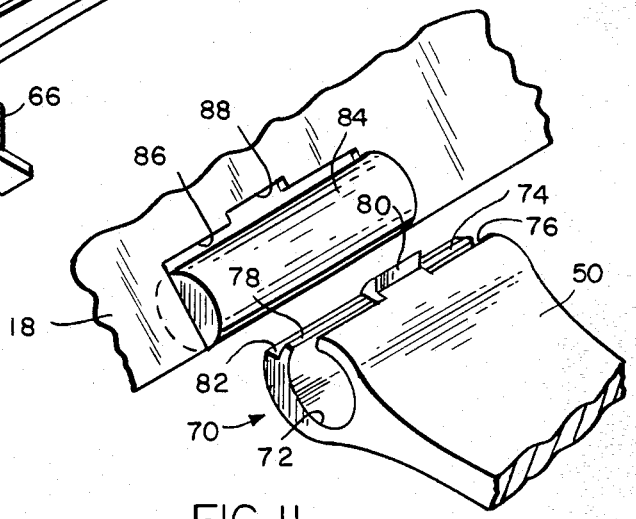
FIG. 11 is a fragmentary perspective of the hinge means shown in FIG. 10 with the hinge means disengaged.
Figure 12:
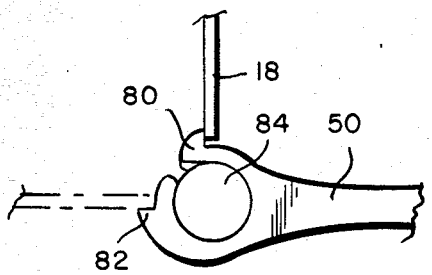
FIG. 12 is section of the hinge means shown in FIG. 11 taken on the line 11—11 of FIG. 11.
Figure 10:
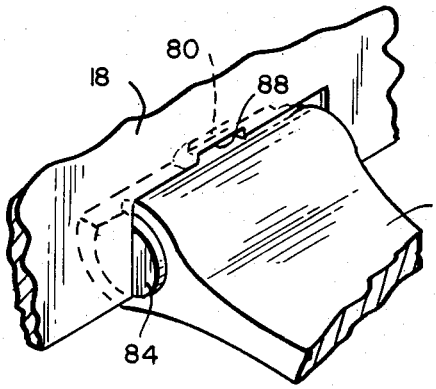
FIG. 10 is a fragmentary perspective of an alternative form of hinge means for connecting the barrier to the support means.

In this form, as shown in FIGS. 10, 11 and 12, the anchor bar 50 has a modified form of hinge element 70 defining a cylindrical channel 72 containing a longitudinal opening 74 which defines spaced, parallel edges 76 and 78. The distance between the edges 76 and 78 is less than the diameter of the channel 72. At the edge 76, there is a latch member 80 and at the edge 74, there is a support member 82. The barrier plate 18 in this form has a cylindrical hinge element 84 dimensioned to be received in the channel 72 and a slot 86 parallel thereto of a width to receive the edge portions 76,78 of the hinge member 70 to enable rotating the barrier relative to the anchor and a notch 88 for receiving the latch 80. The latch 80, by engagement with the notch 88, will hold the barrier 18 in a vertical position, as shown in FIGS. 10 and 12 and the support 82 will hold the barrier plate in a horizontal position when it is retracted, FIG. 12. The hinge means shown in FIGS. 10, 11 and 12 can optionally be substituted for the hinge means 30 at the end of the anchor plate 24 shown in FIG. 2.

Figure 13:
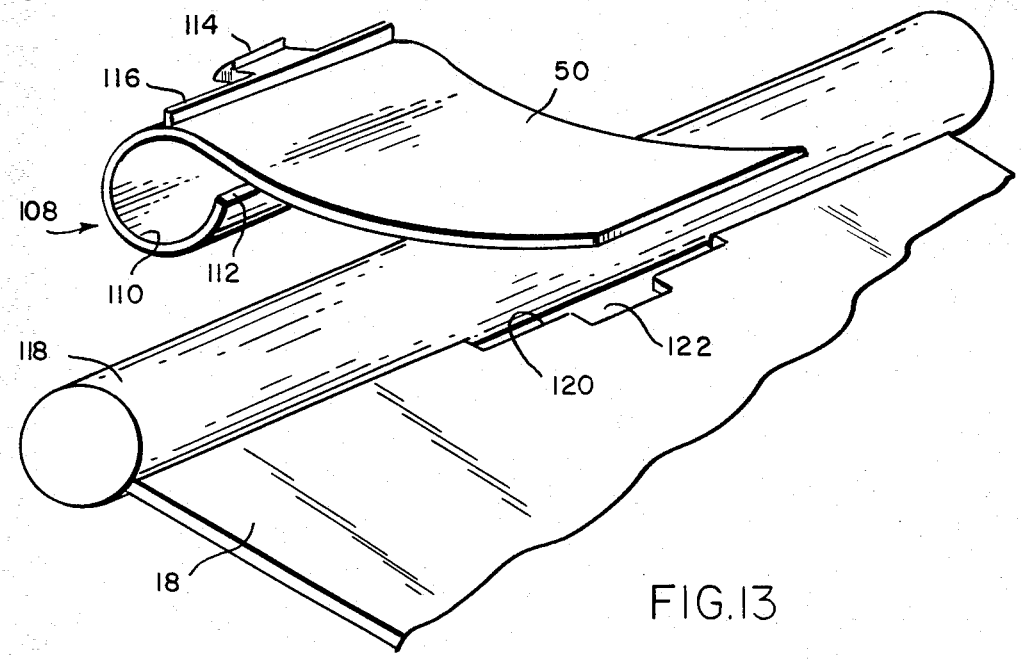
FIG. 13 is a perspective of another form of hinge means wherein the hinge mean supported by the support embodies a backstop and catch.

Another form of support mean is shown in FIG. 13 wherein the anchor plate 50 has hinge element 108 defining a cylindrical channel 110 containing a longitudinal opening 112. The hinge element 108 is provided with catch 114 and backstop 116. The barrier plate 18 in this form has a cylindrical hinge element 118 dimensioned to be received in the channel 110, a slot 120 for receiving the anchor plate 50, and a notch 122 for receiving the latch 114.

Figure 14:
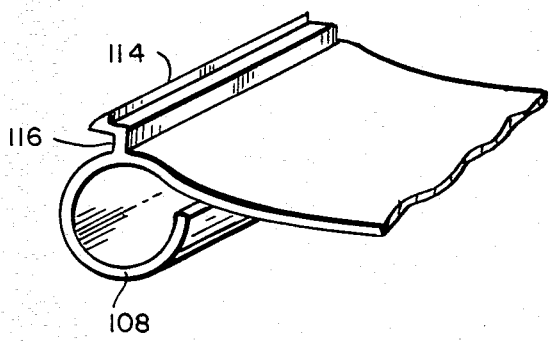
FIG. 14, is a perspective of the hinge means shown in FIG. 13 adapted for manufacture by extrusion.
Figure 15:
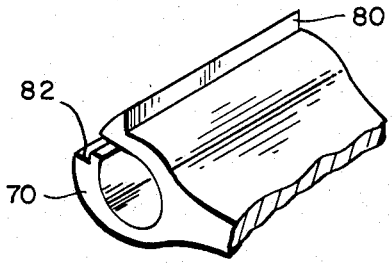
FIG. 15, is a perspective of the hinge means shown in FIG. 11 adapted for manufacture by extrusion.

For manufacturing purposes, the hinge element 108 shown in FIG. 13 and the hinge element 70 shown in FIG. 11 may be extruded as shown in FIGS. 14 and 15 wherein the latch 114 and backstop 118 extend throughout the length of the hinge element 108 and the latch 80 and support 82, FIG. 15, extend throughout the length of the hinge element 70.

Figure 16:
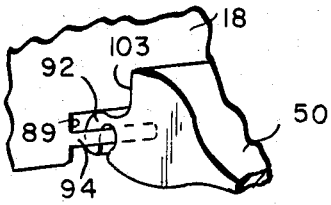
FIG. 16 is a fragmentary perspective of another form of hinge means for connecting the support and barrier.

Another form of hinge means which may be used for connecting the barrier member to the anchor plate or bar 24 or 50 is shown in FIG. 16 wherein the barrier plate has an opening 89 longitudinally thereof along one edge and the hinge means comprises hooks 92—92 at the end of the anchor bar 50 and pins 94—94 at the ends of the opening 89 in the barrier plate rotatably received within the eyes of the hooks.

Figure 17:
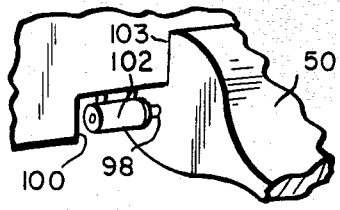
FIG. 17 is a fragmentary perspective of still another form of hinge means for connecting the support means and barrier.

Still another form of hinge means is shown in FIG. 17 wherein the anchor bar 50 has pins 98—98 fixed to it and the barrier plate has an opening 100 within which are mounted spring clips 102—102 which rotatably receive the pins 98—98.

In each of the forms shown in FIG. 16 and 17, the anchor bar 50 has a vertical shoulder or backstop 103 and a latch, not shown, similar to the latch 80 shown in FIG. 10 for holding the barrier in an upright position. There is also provided a support, not shown, such as that shown at 82 in FIG. 10 for holding the barrier plate in the horizontal position.

The support and barrier plate, including the hinge means associated therewith, may be comprised of metal or plastic, for example sheet metal or cast metal or of extruded plastic.

It should be understood that the present disclosure is for the purpose of illustration only and includes all modifications or improvements which fall within the scope of the appended claims.

What is claimed is:

1. A barrier system for the top of a range along one or more sides thereof comprising for each side a barrier member, support means for the barrier member, means for detachably attaching the support means to the range, hinge means supported by the support means adjacent the top and parallel to the side to which the barrier is to be mounted, complementary hinge means at one longitudinal edge of the barrier member for rotatably receiving the hinge means supported by the support means for rotation of the barrier member about an axis parallel to the side of the range from a position perpendicular to the top to a substantially horizontal position, interengageable latch means associated with respective hinge means interengageable by rotation of the barrier member to said perpendicular position to lock the barrier member in said perpendicular position, said latch means being manually disengageable to release the barrier member to permit it to be rotated to said substantially horizontal position and means at said horizontal position of the barrier member to support it in said horizontal position.

2. A barrier system according to claim 1 wherein the support means is detachably attached to the top of the range.

3. A barrier system according to claim 1 wherein the support means is detachably attached to the side of the range.

4. A barrier system according to claim 1 wherein the barrier member comprises a flat, substantially rectangular plate.

5. A barrier system according to claim 1 wherein the means for detachably attaching the holder to the range comprises one or more permanent magnets.

6. A barrier system according to claim 1 wherein there are two support means, each provided with hinge means and the barrier member is provided with two hinge means for engagement with the two hinge means provided by the two support means.

7. A barrier system according to claim 1 wherein the support means comprises an anchor plate with spacer elements for supporting the anchor plate above the top of the range in spaced, parallel relation thereto and the means associated with the anchor attaching it to the top of the range comprises one or more magnets secured thereto.

8. A barrier system according to claim 1 wherein the top of the range has burner openings and the means for detachably attaching the support means to the top of the range comprise clamp means structured to be engaged with adjacent burner openings and means for attaching the support means to said clamping means.

9. A barrier system according to claim 8 wherein the clamping means comprise slidably interengaged bars with hook means at their remote ends longitudinally adjustable to engage the hook means with the burner openings and fastening means for fixing the bars in clamping position and the support means thereto.

10. A barrier system according to claim 1 wherein the hinge means supported by the support means is a channel member of circular cross section having an opening longitudinally thereof within which the hinge means at the longitudinal side of the barrier member is positioned with the barrier member extending through the opening, wherein the hinge means at the longitudinal side of the barrier member is a cylindrical member of a cross section to be rotatably received in the channel member and wherein the distance between the opposite sides of the opening in the channel member is of lesser width than the cylindrical member, but greater than the thickness of the barrier member such as to rotatably retain the cylindrical member within the channel member while permitting the barrier member to be rotated.

11. A barrier system according to claim 10 wherein the latch means comprises a longitudinal recess in the surface of the cylindrical member and there is means defining a lip longitudinally of the channel member along side thereof yieldably engageable within the recess.

12. A barrier system according to claim 11 wherein the means supporting the barrier member in a horizontal position is a flange integral with one side of the channel adjacent the opening therein.

13. A barrier system according to claim 1 wherein the hinge means at the end of the support means comprises a channel member of circular cross section containing a longitudinal opening defined by spaced, parallel edges, the hinge means at the longitudinal side of the barrier member is of cylindrical cross section dimensioned to be rotatably received within the channel member, the distance between said edges is wide enough to receive the barrier member, the latch means comprises a catch at one longitudinal edge and an opening in the barrier member defining an edge engageable with the catch when the barrier member is moved to the vertical position and wherein the other longitudinal edge of the opening provides support for the barrier member when the latter is in its horizontal position.

14. A structure according to claim 13 wherein the hinge members are telescopically interengageable.

15. A barrier system according to claim 1 wherein the hinge means at the end of the support defines a cylindrical opening, the axis of which is parallel to the side of the range to which the barrier structure is to be mounted and the hinge means at the longitudinal edge of the barrier member defines a cylinder dimensioned to be rotatably received in the cylindrical opening.

16. A barrier system according to claim 14 wherein there is an opening in the barrier member for receiving the hinge means of the support means, said opening defining an edge parallel to the edge of the barrier member and a latch fixed to the hinge means of the support engageable with said edge to hold the barrier member perpendicular to the top of the range.

17. A barrier system for the top of a range along one or more sides thereof comprising for each side a barrier member and means for detachably mounting the barrier member to the range for disposition perpendicular to the top of the range such as to extend upwardly from the top of the range comprising articulated hinge components movable relative to each other, means rigidly connecting the barrier member to one of the articulated hinge components, means detachably securing the other of the articulated hinge components to the range and means associated with the articulated hinge components to immobilize one of the articulated hinge components relative to the other with the barrier member in said perpendicular position.

18. A barrier system according to claim 17 wherein the means detachably securing the other of said articulated hinge components to the range provides for attaching said other articulated hinge component to the side of the range.

19. A barrier system according to claim 17 wherein the means for detachably securing the other of said articulated hinge components to the range comprises magnetic means for attaching said other of said articulated hinge components to the side of the range.

* * * * *